US006085571A

United States Patent [19]

Brinas et al.

[11] Patent Number: 6,085,571

[45] Date of Patent: Jul. 11, 2000

[54] GRAVITY-OPERATED BLANK LOADING DEVICE

[75] Inventors: Nelson T. Brinas, Sterling Heights; Gary A. Kruger, Madison, both of Mich.

[73] Assignee: General Motors Corporation, Detroit, Mich.

[21] Appl. No.: 09/327,360

[22] Filed: Jun. 7, 1999

[51] Int. Cl.[7] ..... B21J 13/10

[52] U.S. Cl. ..... 72/420; 72/361; 72/709

[58] Field of Search ..... 72/351, 361, 465.1, 72/466.8, 418–422, 295, 296, 298, 301, 709; 414/225

[56] References Cited

U.S. PATENT DOCUMENTS

| | | | |
|---|---|---|---|
| 4,091,938 | 5/1978 | Trolle | 72/361 |
| 4,474,044 | 10/1984 | Leistner et al. | 72/37 |
| 5,148,697 | 9/1992 | Shiraishi et al. | 72/361 |
| 5,423,648 | 6/1995 | Akeel et al. | 414/225 |

FOREIGN PATENT DOCUMENTS

| | | | |
|---|---|---|---|
| 59-94546 | 5/1984 | Japan | 72/361 |
| 2-187224 | 7/1990 | Japan | 72/361 |

*Primary Examiner*—Ed Tolan
*Attorney, Agent, or Firm*—George A. Grove

[57] ABSTRACT

A device is disclosed for loading and positioning a sheet metal blank between upper and lower tool members adapted to close and engage the blank for the purpose of preforming and heating it in preparation for a superplastic forming operation. The loading device comprises a supported horizontal shaft carrying a rotatable counterbalanced arm with a pad on the arm for use in positioning a corner or edge of the blank. In the operation of the device: (a) the arm is balanced with a suitable counterweight for initially supporting and positioning the blank between the open tools, (b) the arm and its pad rotates downwardly with the blank as the tools are closed drawing the blank between them, (c) the rotating arm and pad release the blank as it is withdrawn from their reach, and (d) the unloaded arm and pad are returned to their initial position by the counter balance.

9 Claims, 4 Drawing Sheets

GRAVITY-OPERATED BLANK LOADING DEVICE

TECHNICAL FIELD

This invention pertains to machines for loading sheet metal blanks between upper and lower forming press tools. More specifically, this invention relates to methods and devices for loading and positioning sheet metal blanks between the forming tools in connection with a superplastic forming operation.

BACKGROUND OF THE INVENTION

There are metal alloys, for example, some aluminum, magnesium and titanium alloys, that display exceptional ductility when deformed under controlled conditions. These aluminum alloys are susceptible to extensive deformation under relatively low shaping forces. Such alloys are characterized as being superplastic. The tensile ductility of superplastic metal alloys typically ranges from 200% to 1000% elongation.

Superplastic alloy sheets are formed by a variety of processes into articles of manufacture that are frequently of complex shape. These superplastic forming (SPF) processes are usually relatively slow, controlled deformation processes that yield complicated products. But an advantage of SPF processes is that they often permit the manufacture of large single parts that cannot be made by other processes such as sheet metal stamping. Sometimes a single SPF part can replace an assembly of several parts made from non-SPF materials and processes.

There is a good background description of practical superplastic metal alloys and SPF processes by C. H. Hamilton and A. K. Ghosh entitled "Superplastic Sheet Forming" in *Metals Handbook, Ninth Edition,* Vol. 14, pages 852–868. In this text several suitably fine grained, superplastic aluminum and titanium alloys are described. Also described are a number of SPF processes and practices for forming superplastic materials. In these practices gas pressure is often used to stretch or form a sheet, that has been heated to a superplastic forming temperature, into contact with the shaping surface of a suitable tool. For SPF aluminum alloys, this temperature is typically in the range of about 400° C. to 565° C. The rate of gas pressurization is controlled so the strain rates induced in the sheet being deformed are consistent with the required elongation for part forming. Suitable strain rates are usually 0.0001 to 0.01 $s^{-1}$.

It is desired to adapt SPF processes to forming relatively large sheets of superplastic aluminum alloys. In order to accomplish this goal, it is necessary to devise methods and equipment to produce complex SPF panels or other parts at large volumes. In connection with this effort it is necessary to devise a sheet blank loader to position, e.g., an SPF aluminum sheet between upper and lower heated tools to pre-bend and heat the sheet preparatory to subjecting it to stretch forming or other suitable superplastic forming process. Such a loading device must function suitably in the SPF processing environment for the sheet blank which in the case of aluminum alloys is typically about 800° F. to 1050° F. (425° C. to 565° C.).

It is an object of this invention to provide a relatively uncomplicated and inexpensive blank loader of such capability.

SUMMARY OF THE INVENTION

This invention provides a durable loading device for loading a metal blank into a vertically actuated sheet metal forming press. In one application, the subject loading device is useful for positioning an SPF aluminum alloy sheet between open, upper and lower forming tools. The tools may, e.g., be adapted to preform and heat the sheet blank preparatory to superplastic forming of the sheet.

In accordance with one embodiment of the invention, four loading devices are used inside the press to position the four corners of a rectangular blank between the open tools. The blank is supported by the loaders in a position or attitude suitable for the sheet to be drawn between mating tools as they are closed. Each loader comprises a suitably supported, counterbalanced, rotatable arm carrying a pad adapted to suitably secure a corner or edge of the blank. Preferably, the counterbalance and arm rotate on a shaft and include a suitable bushing to facilitate rotation. In the vertically actuated press, the upper tool is lowered to engage the periphery of the sheet and push or move it downward against the lower tool. As the sheet is lowered, each loader arm rotates downward to permit the sheet to be drawn into the lower tool. Ultimately the arm rotates enough to release the sheet. When the sheet is clear of the arm of each loader, the counterbalance raises the arm and pad to their original position.

As the thin sheet, typically one to three millimeters thick, is drawn between the press tools, it is suitably preformed and heated to 800° F. or higher. The tools are opened and the hot preform is then quickly moved to SPF forming tooling. As soon as the preformed and heated sheet has cleared the preform tools, another blank can be placed on the four loaded devices and the preform/heating cycle repeated.

In this embodiment, the loader devices of this invention are located in the hot press. Thus, the loader, especially the shaft and bushing, are formed of suitable materials to function in the hot environment.

The number of loader devices used often depends on the configuration of the tools. One skilled in the art can employ a suitable number.

Other objects and advantages of the invention will become apparent from a detailed description which follows. Reference will be had to the drawings which are described in the following section.

DESCRIPTION OF THE PREFERRED EMBODIMENT

Figure 1:
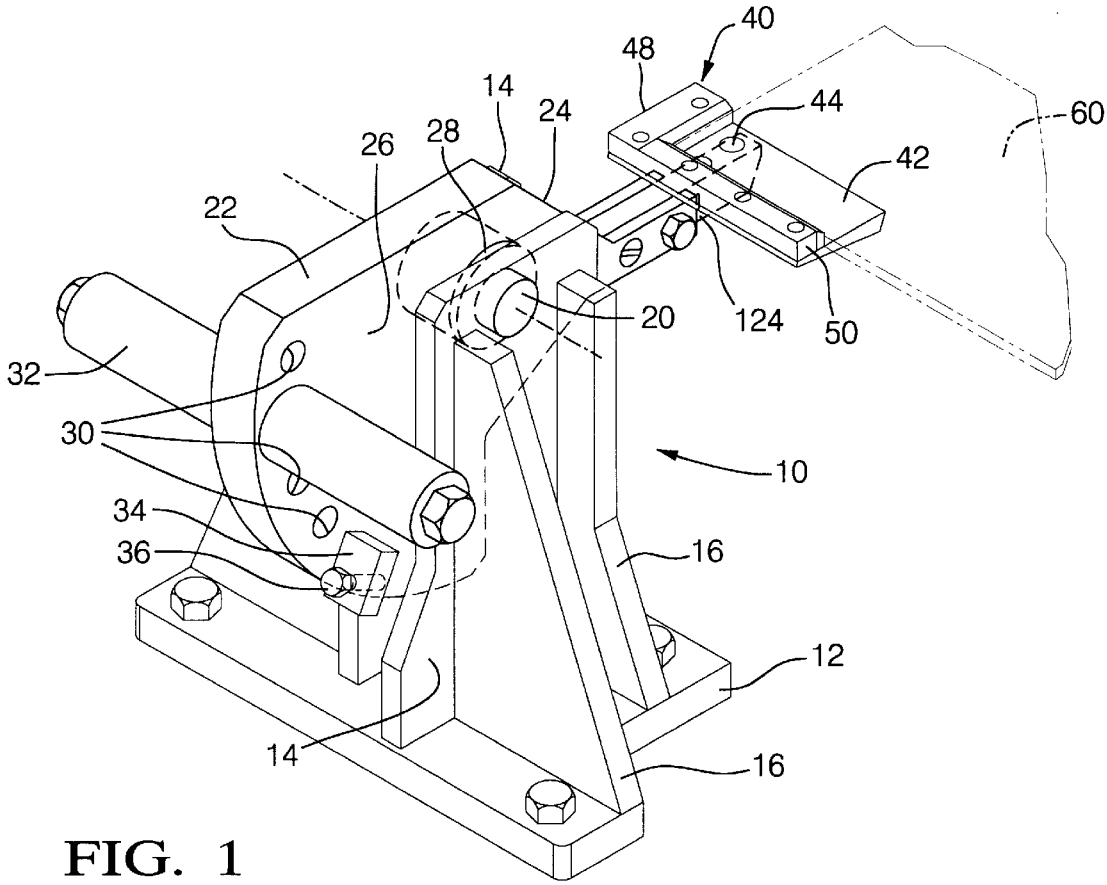
FIG. 1 is a perspective of a blank loader of this invention.

FIG. 1 shows a gravity-operated blank load device of this invention. Except for some critical parts that will be identified below, a suitable loader may be formed of a low carbon steel (e.g., 1010 or 1040 steel) plate.

A load device 10 comprises a base plate 12 with two vertical stanchions or standards 14. The standards 14 are welded at their bottom ends to base 12. Standards 14 are buttressed by gussets 16. Holes 18 are bored in the upper ends of standards 14 to support shaft 20. Shaft 20 is removable from standards 14 but is fixed in holes 18 by a set screw (not shown) or the like during the operation of the loader. For high temperature uses of loader 10, as contemplated herein, it is preferred that shaft 20 be formed of an oxidation resistant alloy such as high silicon austenitic stainless steel.

A unitary arm-counterbalance lobe plate is indicated at 22. This unitary plate 22 includes an arm portion 24 and a lobe portion 26 for counterbalancing arm 24 and extensions of it. Plate 22 has an inserted bearing bushing 28 to facilitate rotation of the arm and counterbalance structure about shaft 20. It is also preferred that bushing 28 be formed of high silicon austenitic stainless steel to retain a smooth bearing interface with shaft 20, even at temperatures of the order of 1050° F. in air.

In this embodiment, lobe 26 constitutes about a quarter of a circle and holes 30 are provided at the circumference of the counterbalancing lobe for a counterweight(s) 32. A small bracket 34 is welded to the lower portion of lobe 26 for a bolt 36 to provide a stop against a standard 14.

Provision is made at the end of arm portion 24 for an arm extension 124 of adjustable length. For example, the connection between arm 24 and arm extension 124 may be a slotted tongue and groove connection fixed by bolts 38. At the end of arm 24/124 is a pad member 40 for use in supporting and locating a corner or an edge of a sheet metal blank.

Pad member 40 comprises plate 42 bolted at 44 to arm extension 124. Bolted (see bolts 46) in turn to plate 42 are brackets 48 and 50 for locating, e.g., the corner of a sheet metal blank.

The utility and operation of loader 10 is illustrated in FIGS. 3 and 4A–4D.

Figure 2:
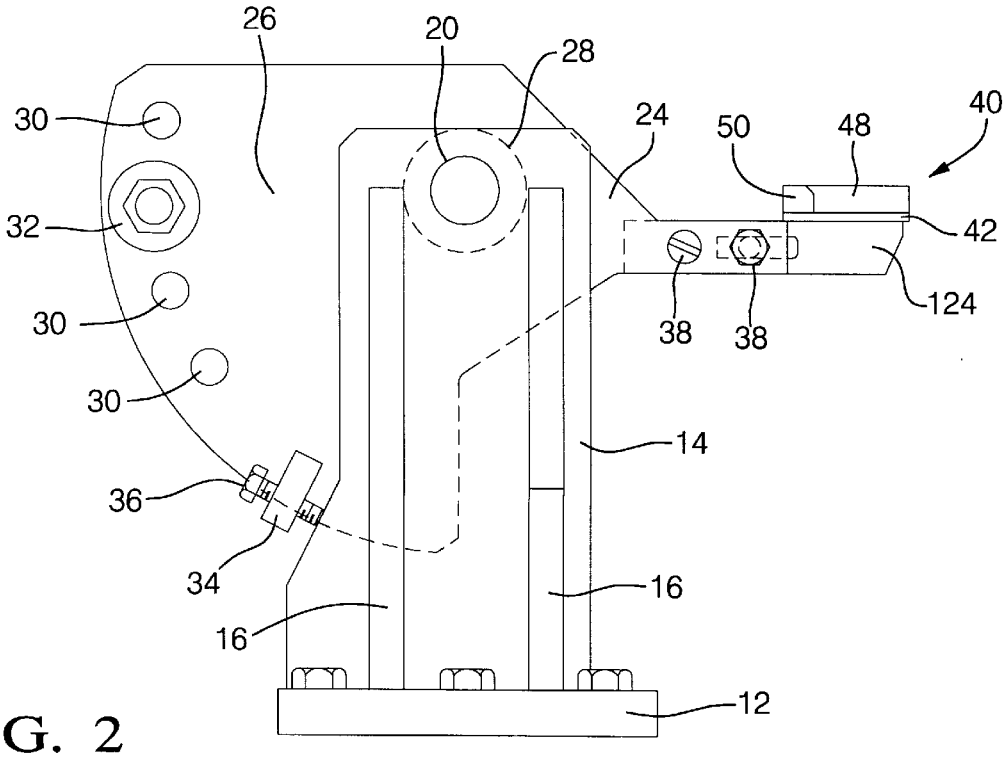
FIG. 2 is a side view of a blank loader of this invention.
Figure 3:
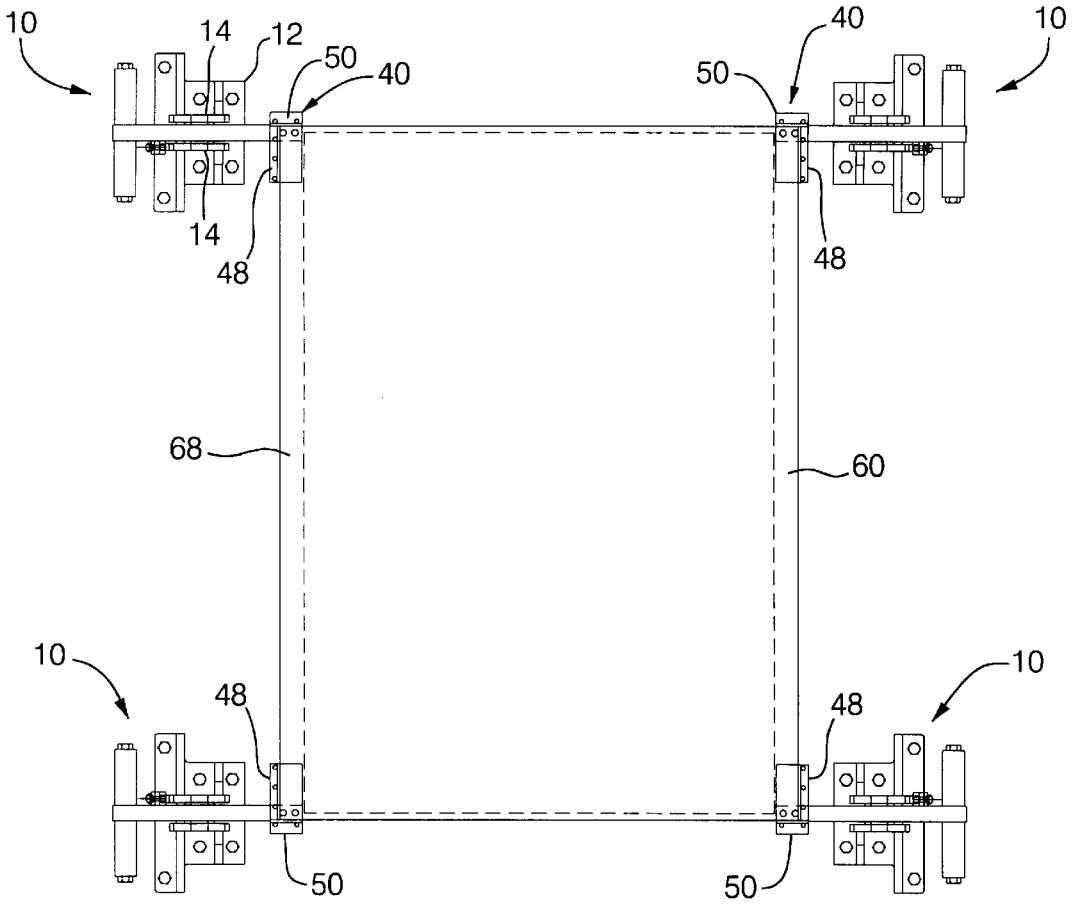
FIG. 3 is a plan view of four blank loaders positioning a sheet blank over a lower preform and heating tool.

FIG. 3 illustrates the use of four of the subject loaders 10 supporting and positioning a sheet metal blank 60 over a lower tool member 68 shown in hidden lines in FIG. 2A below blank 60. The brackets 48 and 50 in the respective pad members of the four loaders are arranged in fixing the position of blank 60.

As seen in FIGS. 4A through 4D, blank 60 is positioned in an opened press 62 (not fully shown). Press 62 comprises upper tool 64 carried on upper platen 66 and lower tool 68 carried on lower platen 70. Lower tool 68 has a punch shape and upper tool 64 a complementary shape for bending blank 60. FIGS. 4A through 4D are cross sections of the tools 64 and 68. In this embodiment, the shape of both tools is the same over their lengths so that their function is to preform blank 60 by bending it as shown in the cross section.

A further function of press 62 is to heat blank 60 to a suitable superplastic forming temperature for the material. In the case of AA 5083, e.g., this temperature is in the range of about 800° F. to 1050° F. Electrical resistance heating rods (not shown) are embedded in platens 66 and 70 to heat blank 60 from ambient temperature to its SPF temperature during press closure and thereafter for a suitable time.

As seen in FIGS. 4A–4D, the crown 72 on lower tool 68 is near the centerline of blank 60 and four loaders 10 are suitably used to support and position the blank 60 just above the crown 72 of lower tool 68. The respective loaders 10 are carried on and bolted to plate 74 interposed between tool 68 and its platen 70.

Figure 4A:
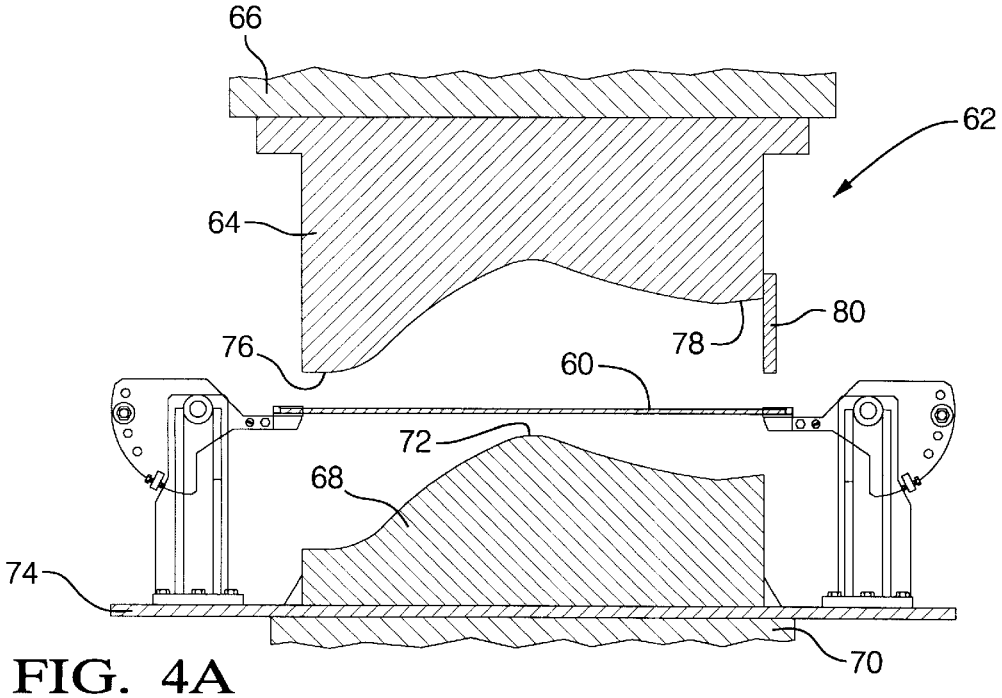
FIGS. 4A through 4D illustrate the use of four loaders in positioning a sheet blank between upper and lower preform and heating tools.
Figure 4B:
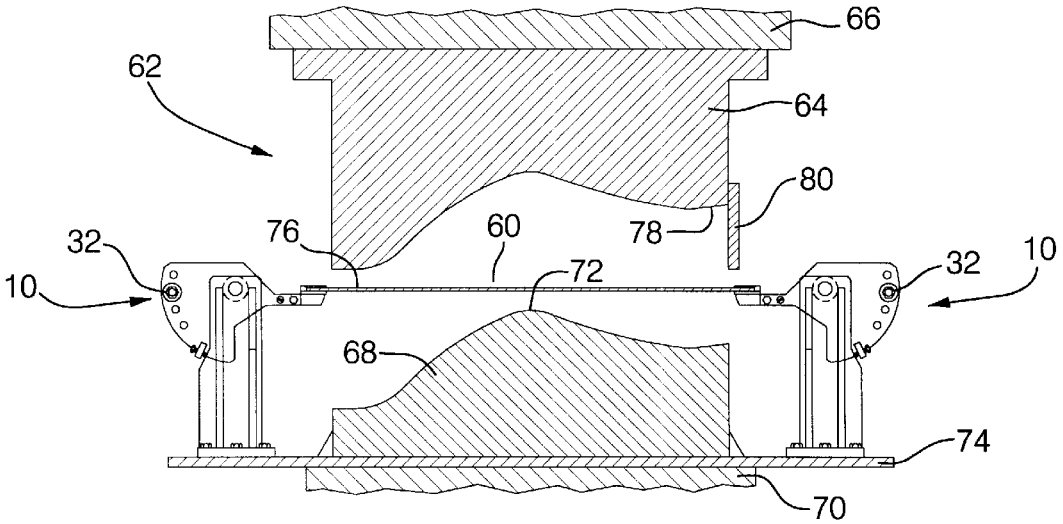
Figure 4C:
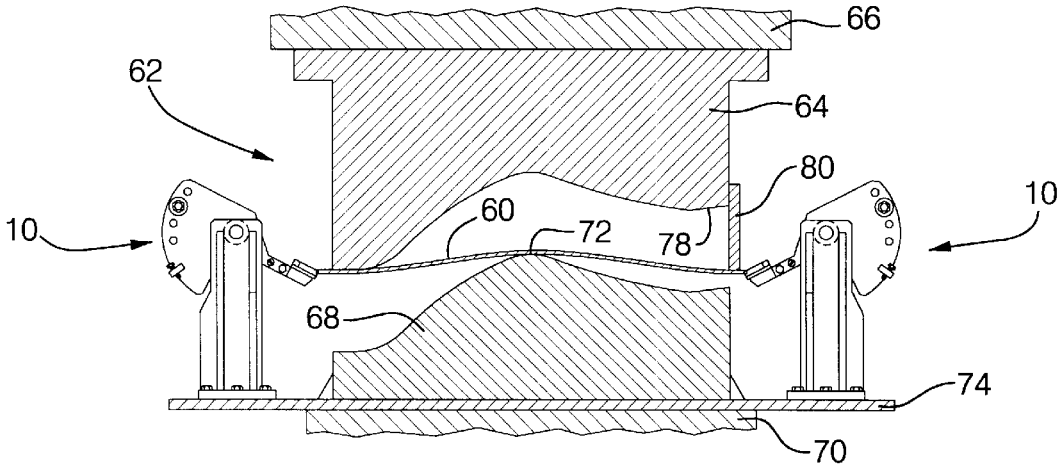
Figure 4D:
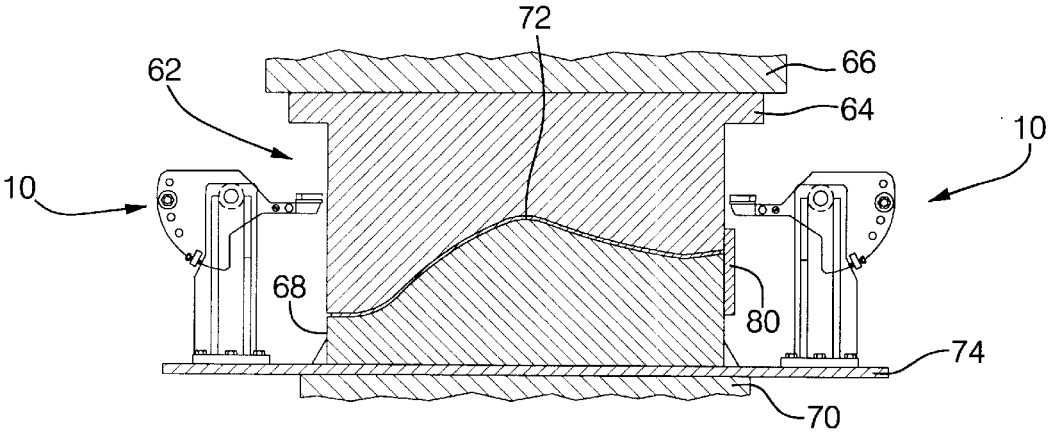

In FIG. 4A the loaders are all at the same height and hold blank 60 in a level attitude. Suitable counterweight 32 is employed to force stop bolt 36 against standard 14 and each loader carries its share of the weight of blank 60. In FIG. 4B the press is closing, i.e., the upper tool 64 and platen 66 are moved downwardly so that the lower edge 76 of upper tool 64 just touches blank 60. Since the upper edge 78 of upper tool would not yet touch blank 60, one or more extension rods 80 are positioned between the two loaders on the right side of the press as seen in FIG. 4C. As the upper tool continues with its downward movement, the blank 60 is gradually bent around crown 72 and the loader arms are rotated downwardly. As the sheet blank is drawn over crown 72, it is pulled away from the pads of the respective loaders. When this happens, the counterbalance lobe and counter weight return the arm of each loader to its initial position (see FIG. 4D).

The press remains fully closed to bend and heat the sheet to remove any spring-back tendency and to raise its temperature to a level at which the material may undergo substantial plastic deformation in an SPF process. When the sheet is suitably heated, the press is quickly opened and the hot sheet quickly removed with a robot or other suitable device, not shown and not part of this invention, and moved to SPF tooling in which additional forming of the hot, bent blank is performed. Press 10 is now fully opened and, as stated, the counterbalanced arms of the four loaders have each been returned under the force of gravity to their predetermined blank supporting and locating positions (shown in FIG. 4A).

Figure 5:
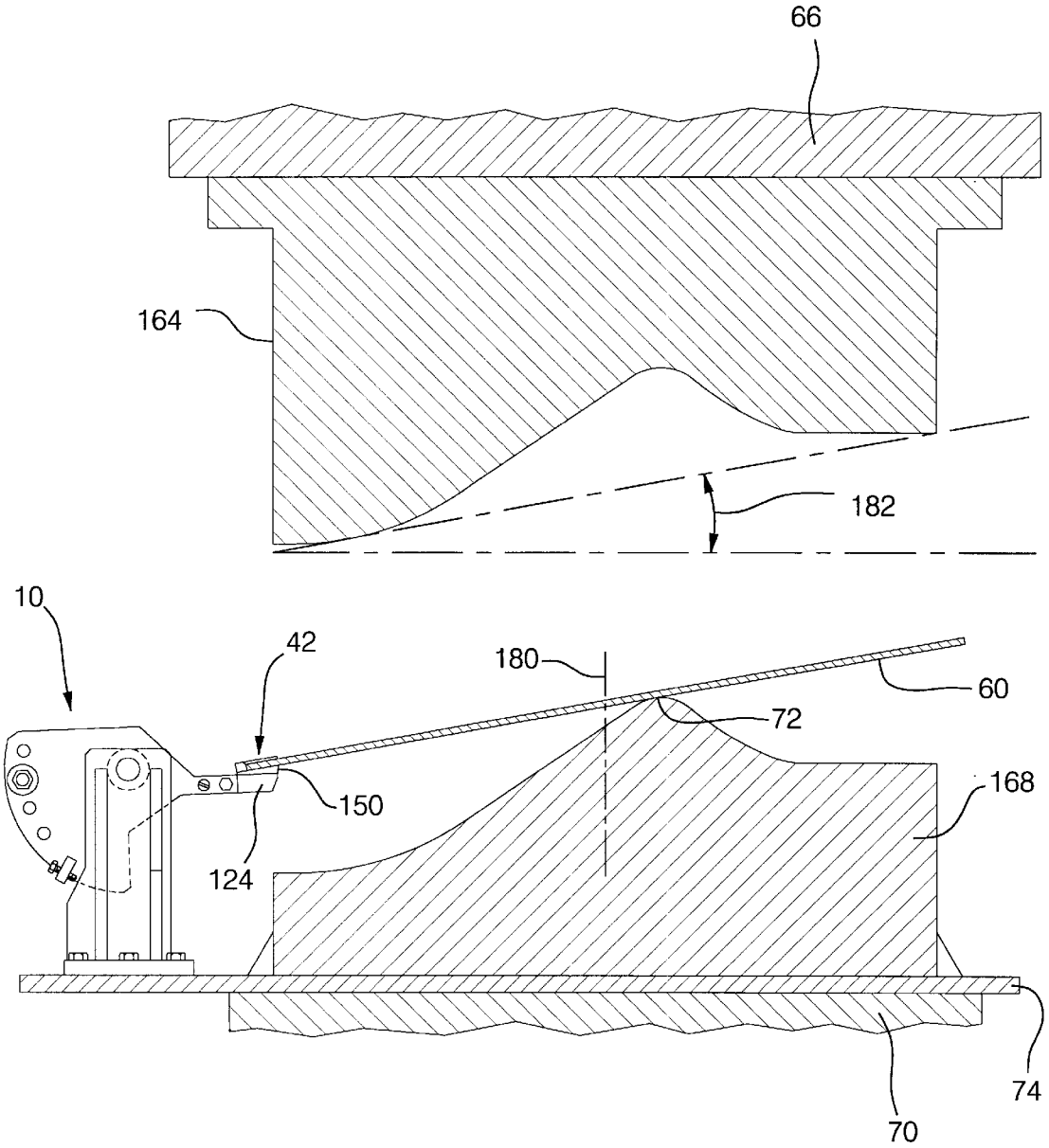
FIG. 5 illustrates an embodiment of the invention in which two loaders are used.

FIG. 5 illustrates another embodiment of the invention in which two loaders 10 are employed. In this embodiment the crown on the lower tool is offset from the centerline 180 of the blank. In this situation the crown 172 may be used to partially support the blank 60 and only two loaders 10 are used to hold and position the left edge of the blank as viewed in FIG. 5. The function of the loaders is the same as in the previous example. The construction of the loaders is essentially the same except that an angled pad member 150 is inserted between arm 124 and bracket 42 to better accommodate the incline 182 of the blank in this embodiment.

In view of the above examples, it is clear that the number of loaders may vary from application to application. However, it also clear that the subject counterbalanced arm loader will serve to expedite the processing of high temperature blanks for SPF and other forming operations.

Therefore, while the invention has been described in terms of a specific embodiment, it will be appreciated the other forms could be devised by those skilled in the art without departing from the scope of the invention which is limited only by the claims which follow.

What is claimed is:

1. Apparatus for use in locating and supporting a sheet metal blank between upper and lower sheet metal forming tools, said tools being movable between open and closed positions, said apparatus comprising a supported horizontal shaft, an arm and gravity-operated counterbalance member rotatably mounted on said shaft, said arm and counterbalance member extending in opposing radial directions from said shaft, and a pad mounted on said arm for releasably supporting said blank;

said arm, counterbalance member and pad cooperating to (a) locate said blank when said tools are in their open position, (b) release said blank as said tools move to their closed position and (c) return said arm and pad to their blank locating position after release of said blank.

2. Apparatus as recited in claim 1 in which said shaft is supported by a base with vertical standards.

3. Apparatus as recited in claim 1 in which said counterbalance member comprises a counterweight to balance said sheet on said pad before said tools are closed.

4. Apparatus as recited in claim 1 in which a stop means is interposed between said counterbalance member and a standard to position said arm before a said blank is placed on it.

5. Apparatus as recited in claim 1 comprising said counterbalance member and said arm as an integral plate.

6. Apparatus as recited in claim 5 in which said integral plate also comprises a bushing for rotational engagement with said shaft.

7. Apparatus as recited in claim 1 in which said shaft is formed of a material for operation at temperatures of 800° F. to 1050° F.

8. Apparatus as recited in claim 6 in which said shaft and said bushing are formed of a material for operation at temperatures of 800° F. to 1050° F.

9. Apparatus as recited in claim 2 in which said base is adapted to be attached to a common support with said lower tool.

* * * * *